United States Patent [19]

Turk

[11] 4,124,265

[45] Nov. 7, 1978

[54] QUICK SLIDE CONNECTOR

[75] Inventor: Frederick J. Turk, St. Paul, Minn.

[73] Assignee: Minnesota Mining and Manufacturing Company, Saint Paul, Minn.

[21] Appl. No.: 850,300

[22] Filed: Nov. 10, 1977

[51] Int. Cl.[2] ..... H01R 11/20

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,500,292 | 3/1970 | Enright et al. | 339/97 R |
| 3,609,644 | 9/1971 | Seim | 339/98 |
| 3,950,063 | 4/1976 | Johansson | 339/97 R |

*Primary Examiner*—Joseph H. McGlynn

*Attorney, Agent, or Firm*—Cruzan Alexander; Donald M. Sell; John C. Barnes

[57] ABSTRACT

An insulated solderless wire connector for making a quick connect connection between a wire and a male blade conductor, including an insulative body member retaining at least one planar contact element.

4 Claims, 4 Drawing Figures

QUICK SLIDE CONNECTOR

BACKGROUND OF THE INVENTION (1) Field of the Invention

This invention relates to reuseable, quick connect electrical wire connectors. It is desirable to achieve a solderless connection of an insulated wire and a termination to permit quick connect or separation with a male blade conductor. It is desirable to miniaturize the connector to use the smallest amount of metallic and polymeric materials possible in such a connector. Minimization of materials requirements permits the economic manufacture and sale of such connectors.

SUMMARY OF THE INVENTION

An important object of the present invention is to provide a unique connector which may be economically and easily used to provide a quick disconnect termination with an insulated wire.

The invention comprises a planar contact element which has an insulation displacing and spring reserve wire contacting portion for making contact with an insulated wire and a slot portion for resilient connection with a male blade conductor. The arms forming the slot for receiving the male blade are tapered to minimize material requirements and to distribute stress.

Since the contact element is planar is may be conveniently stamped out of any suitable flat metallic material, including cartridge brass (CDA Alloy 260), beryllium copper, or aluminum alloy. Stamping from a flat sheet permits tighter tolerances to be held than are possible with conventional bent contacts.

The lack of subsequent bending operations in the formation of the contact also permit the use of materials with high temper such as Brass Alloy CDA Alloy 195 NK temper which are less suitable for bending operations. The use of high temper materials permits adequate spring reserve contact while reducing the amount of metallic material used in the connector.

Another advantage of the planar contact is that the mechanical characteristics and performance of the contact do not depend strongly on the thickness of the contact. This permits relatively wide thickness tolerances without a noticeable decrease in the quality of the contact produced.

The planar element is retained in an insulative body member formed from a suitable polymeric material such as polypropylene or nylon, which positions the planar element so that it may make electrical contact with both the insulated wire and the male blade conductor. The body member comprises upper cover, and lower body portions which portions may be connected by a flexible hinge. Wire receiving and support areas are formed in the upper and lower body portions which hold an insulated wire and permit it to be driven into insulation displacing and resilient contact with the wire contacting portion of the planar element when the body portions are forced together into the closed position. A slot area formed in the body member provides an opening for receiving and guiding the male blade conductor into the planar contact. The insulative body portions which form the slot area maintain the male blade conductor in a plane perpendicular to the plane of the planar connector element.

Retaining and aligning means located on the body members secure the portions of the insulative body member in the closed position.

In applications where the wire may be pulled out of the connector body, two planar contact elements may be positioned within the insulative body member to increase the resistance to wire pull-out. Also, by positioning two planar contact elements in the insulative body the male blade may be inserted very deep into the contact element without contacting the dimple or hole which is present in the center of some male blades.

DESCRIPTION OF THE PREFERRED EMBODIMENTS

Figure 1:
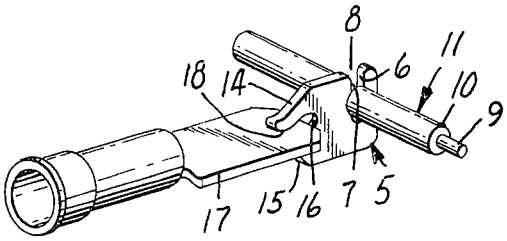
FIG. 1 shows an isometric view of the planar element making contact with both an insulative wire and a conventional male blade conductor.

In FIG. 1, the substantially parallel edges 6 and 7 of the planar contact element 5 define a wire receiving slot for making spring reserve electrical contact with a standard or solid insulated conductive wire 9. When the wire 11 is forced into the wire receiving and insulation displacing mouth 8, the insulation 10 is forced away from the wire conductor 9 permitting the wire conductor to make resilient contact with edges 6 and 7. The planar element 5 also has bifurcated portions forming a pair of arm 14 and 15. These arms coverge to form a blade receiving slot 16 generally perpendicular to the mouth 8 which arms contact male blade conductor 17. When a blade conductor 17 is forced into the slot 16, the arms 14 and 15 are displaced within the plane of the contact element and form electrical contact with the blade conductor over a contact area 18. The contact area 18 depends upon the thickness of the blade conductor, and is independent of the distance which the blade conductor is inserted into the planar element. The arms 14 and 15 are tapered to minimize the amount of material necessary to form the planar element and to distribute stress.

Figure 2:
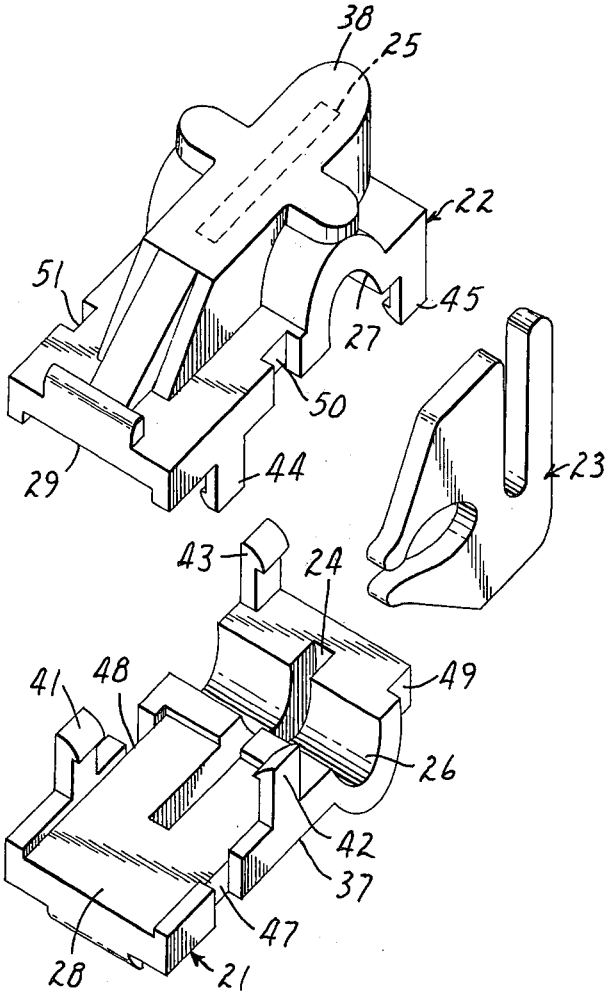
FIG. 2 shows an exploded isometric view of the planar contact element and a two piece insulating body for receiving a conventional male blade conductor.

FIG. 2 shows the insulative body formed by an upper cover body portion 21 and a lower base body portion 22 in the open position. Cooperative channels 24 and 25 are formed respectively in the upper and lower body surfaces. These channels are adapted to functionally receive the planar element 23 and position it in a plane perpendicular to wire receiving channels 26 and 27. Planar regions 28 and 29 are formed in the upper and lower body members respectively. When a body is closed, these planar regions provide a channel for aligning the male blade element perpendicular to the planar element as it enters the blade receiving mouth of the planar element 23.

Retaining and aligning means are provided to retain the insulative body in the closed position. Posts with hook portions, 41, 42, 43, 44, 45 and a sixth post not shown, enter aligned notched areas 47, 48, 49, 50, 51 and a sixth notch not shown about the periphery of the body portions when the body member is closed. The post members deflect outwardly during the closing operation and then hook onto planar regions of the body portions to effectively hold the body member in a closed position.

In operation, the planar contact is seated in slot 24 and a wire is placed in the wire receiving channel 27 of the lower body portion 22. The upper body member is then placed over body portion 21 and aligned. A suitable crimping device, such as pliers, is then applied to the flat surfaces 37 and 38 of the upper and lower body portions, and is used to force the body portions toward each other. This causes the wire to enter the insulation displacing mouth of the planar contact element from the wire and forces the wire conductor into resilient electrical contact with the substantially parallel walls of the planar contact element. Simultaneously, the latch means 41–45 are engaged with notches 47–51 which co-act to latch the body in the closed position. This completes the assembly of the quick disconnect termination onto the insulated wire. A male blade conductor may be inserted through the blade receiving opening of the body member bringing the male blade conductor into contact with the planar surfaces 28 and 29 which guide the male blade into the mouth of the blade contacting portion of contact element 23 which makes electrical contact through the contact element with the wire.

Figure 3:
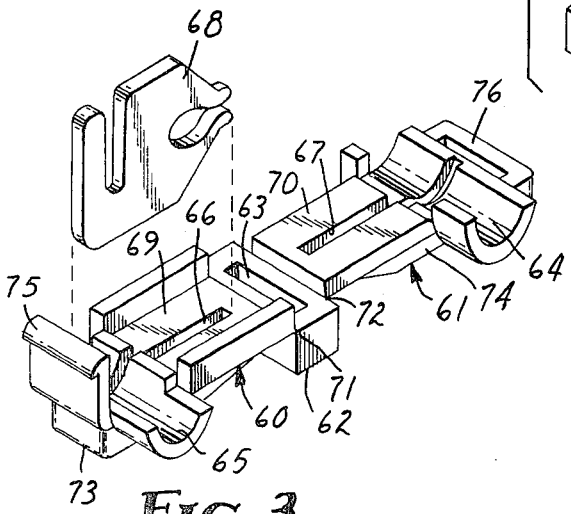
FIG. 3 shows an exploded isometric view of a planar contact element, and a one piece hinged insulative body.

In FIG. 3, the insulative body is formed as a unitary structure. The upper body portion 60 and lower body portion 61 are shown hinged to a center section 62 which contains a slot 63 for receiving the male blade conductor. Wire receiving channels 65 and 64 are formed in the upper and lower body portions respectively. Cooperative channels 66 and 67 are formed in the upper and lower body members transverse to the wire receiving channel. These slots position and frictionally retain a planar contact element 68 in a perpendicular relationship with planar surfaces 69 and 70 which are formed on the upper and lower body members respectively. In operation the planar contact element is placed within slot 66 and the insulated wire is placed in wire receiving channel 64.

After a wire is placed in wire receiving channel 64 the body portions are folded at hinges 71 and 72 to bring the insulation piercing mouth structure of the planar element 68 into contact with the wire lying in channel 64.

Figure 4:
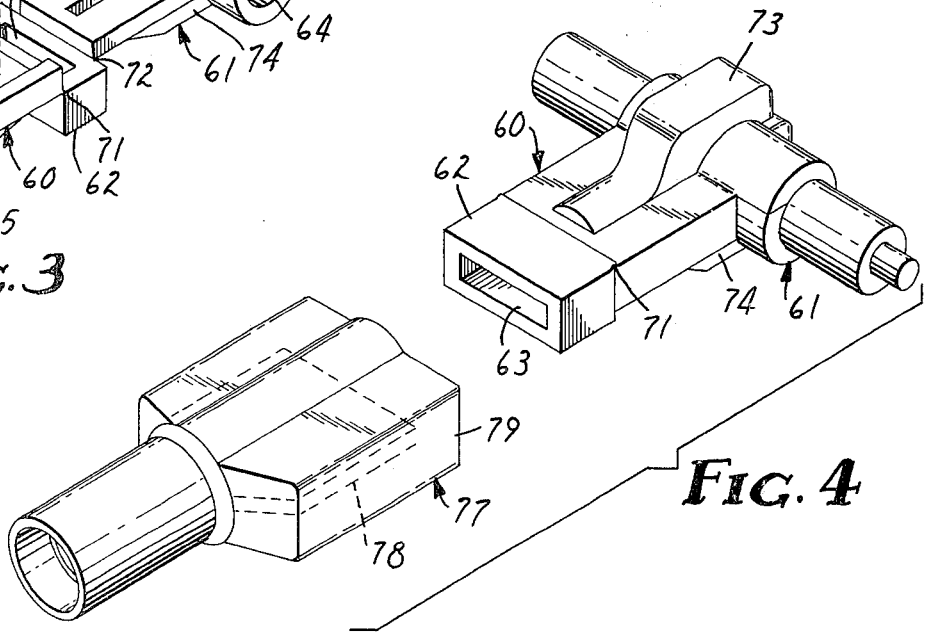
FIG. 4 shows an isometric view of the connector of FIG. 3 in the closed position for receiving a fully insulated male blade conductor.

A crimping device such as a pair of pliers is applied to flat surfaces 73 and 74 shown in FIG. 4, to crimp the connector into the closed position. Retaining and aligning structure 75 then hooks the loop structure 76 of the lower body member retaining the connector in the closed position.

The embodiment shown in FIGS. 3 and 4 is also useful for forming a connection with a fully insulated male blade conductor shown generally as 77. A conventional male blade conductor 78 within the insulating sleeve is shown in phantom view in FIG. 4. The rectangular outline of the finished connector guides and aligns the insulating sleeve 79 of the fully insulated male conductor. This permits the male blade 78 to enter the slot 63 of the connector where it makes electrical contact with the planar element 68 contained within the body of the connector.

In applications where additional resistance to wire pull out is desired, two or more planar contacts may be positioned in spaced parallel channels within an insulative body. Additionally, projections can be formed on the body portions to project into the wire receiving channels to indent the insulation on the wires to resist longitudinal movement of the wire.

What is claimed is:

1. A solderless electrical connector for making permanent electrical contact with an insulated wire and quick connect electrical contact with a male blade conductor comprising at least one planar electrically conductive contact element and an insulative body member, said planar element having a U-shaped spring reserve wire contact slot defined by substantially parallel edges including an area where said edges smoothly diverge forming a wire receiving and insulation displacing mouth, said planar element further includes a bifurcated portion forming a pair of arms, said arms having opposed edges defining a blade receiving slot, said blade receiving slot having an area of diminished cross-section such that a blade terminal inserted into said blade receiving slot is resiliently contacted at the area of diminished cross-section by said arms, said insulative body member is formed as an upper and lower body portion, first and second wire receiving channels are formed in the upper and lower body portions respectively, which form a tubular wire receiving channel when the upper and lower body portions are placed in the closed position, said upper and lower body portions having channels transverse to said wire receiving channels for accepting and retaining said planar element and permitting the same to be driven into insulation penetrating and resiliently loaded wire contacting engagement with a wire lying in said wire receiving channel formed in said lower body portion, said upper and lower body portions also having planar blade support areas for aligning and supporting said male blade conductor when said male blade conductor is driven into engagement with said bifurcated portion of said planar element, said upper and lower body portions also forming an entry slot for receiving said male blade conductor, and retaining means for securing said upper and lower body portions in the closed position.

2. The solderless connector of claim 1 wherein said latch means comprises, a plurality of latching posts formed on the periphery of said upper and lower body portions, extending in a direction perpendicular to the plane of said planar blade support areas, and a plurality of latching notches formed on the periphery of said upper and lower body portions for receiving said latching posts when said upper and lower body portions ar crimped into the closed position.

3. The solderless connector of claim 1 wherein said insulative body member further includes a center section having a male blade conductor receiving slot, and hinge means attaching said upper and lower body portions to said center section.

4. The solderless connector of claim 3 wherein said retaining means comprises a latch notch hook formed on one of said upper or lower body portions adjacent to said wire receiving channel and, a cooperative latch recess formed adjacent to said wire receiving channel on the other of said upper or lower body portions such that said latch hook will engage said latch recess when said body portions are closed.

* * * * *

UNITED STATES PATENT AND TRADEMARK OFFICE

CERTIFICATE OF CORRECTION

PATENT NO. : 4,124,265

DATED : November 7, 1978

INVENTOR(S) : Frederick J. Turk

It is certified that error appears in the above-identified patent and that said Letters Patent are hereby corrected as shown below:

Column 1, line 28, change the second "is" to -- it --;

Column 2, end of line 28, start of line 29, change "stan-", "dard" to -- stranded --;

Column 2, line 56, change "a" to -- the --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*